US006536325B2

(12) United States Patent
Badia Ba

(10) Patent No.: US 6,536,325 B2
(45) Date of Patent: Mar. 25, 2003

(54) HYDRAULIC CYLINDER FOR TELESCOPIC ARMS

(75) Inventor: José Maria Badia Ba, Zaragoza (ES)

(73) Assignee: Partek Cargotec, S.A. (ES)

( * ) Notice: Subject to any disclaimer, the term of this patent is extended or adjusted under 35 U.S.C. 154(b) by 0 days.

(21) Appl. No.: 09/902,210

(22) Filed: Jul. 10, 2001

(65) Prior Publication Data

US 2002/0005112 A1 Jan. 17, 2002

(30) Foreign Application Priority Data

Jul. 11, 2000 (ES) ..... 200001726

(51) Int. Cl.[7] ..... F01L 15/00
(52) U.S. Cl. ..... 91/189 A; 212/349
(58) Field of Search ..... 91/189 R, 189 A; 212/349

(56) References Cited

U.S. PATENT DOCUMENTS 3,871,265 A * 3/1975 Koga et al. ..... 91/189 R
5,501,346 A * 3/1996 Wimmer ..... 212/349

FOREIGN PATENT DOCUMENTS

| | | |
|---|---|---|
| DE | 2310550 | 9/1973 |
| EP | 0562096 | 9/1993 |
| WO | 9308116 | 4/1993 |
| WO | 9310034 | 5/1993 |
| WO | 9641764 | 12/1996 |

* cited by examiner

*Primary Examiner*—F. Daniel Lopez
(74) *Attorney, Agent, or Firm*—Ostrolenk, Faber, Gerb & Soffen, LLP

(57) ABSTRACT

Hydraulic cylinder for telescopic arms, especially crane arms, consisting of a sleeve (1) closed by means of end covers (2) and (3); an internal piston (4) delimiting expansion (5) and retraction (6) chambers, a tubular shank (16) associated to the piston which protrudes through the cover (3) and which is closed by a head (17) which is provided with a pilot piston (21). Inside the tubular shank (16) runs a tube (18) which may be partially moved by the action of the piston (21). The inlet mouth of the cover (2) has a conduit (11) with a bushing (14), which moves when pushed by the tube (18). The conduit (11) and the tube (18) have orifices (13') in their wall.

3 Claims, 4 Drawing Sheets

1
16

24
25
26
18
3
17
19
20

HYDRAULIC CYLINDER FOR TELESCOPIC ARMS

The present invention refers to a hydraulic cylinder for telescopic arms, especially arms consisting of several telescopic sections which expand and retract sequentially, with each section housing a cylinder which begins to operate at the end of the run of the cylinder of the immediately previous or following section, in the stages of extension and retraction, respectively.

Telescopic arms with the above-described composition form part, for example, of hydraulic cranes with a telescopic arm in which each section does not extend or retract until the preceding arm cylinder has arrived at the end of its hydraulic run. Likewise, the retraction of any cylinder cannot occur until the cylinder which is being retracted reaches its position of complete retraction.

Cylinders are known which satisfy this principle for the expressed purpose. In this sense, the European patent EP0562096 may be mentioned, related to a loading crane with a jib or arm comprising several sectors which may be telescopically coupled, inserting in each other, each sector being fitted with a hydraulic cylinder by means of which the sequential extension or retraction of the different sections is achieved, such that each section does not start its extension until the cylinder housed in the preceding section has arrived at the end of its hydraulic run, with retraction occurring in a similar manner. For this reason each section is provided with a stop which activates a valve when the arm reaches its retracted position, allowing passage of the hydraulic liquid towards the cylinder of the following arm. This valve is located in the closed end of the hydraulic cylinder of each arm.

Said composition may present operation problems and basically demand a complicated composition due to the fact that the valve which controls the extension or retraction in the different arms consists of a flow valve for hydraulic fluid.

The object of the present invention is to eliminate the aforementioned problems by means of a cylinder of simple composition and operation, and whose retraction or extension operations are controlled by means of a device which does not control nor is in contact with the hydraulic fluid for cylinder activation.

The cylinder of the invention has a known general composition, consisting of a cylindrical sleeve closed by end covers, an internal piston delimiting expansion and retraction chambers, a tubular shank associated to the piston which protrudes through the rear cover and is closed by a head integrally joined to said shank and passage orifices for the expansion and retraction chambers.

In the cylinder of the invention, the cover closing the expansion chamber includes the passage hole to this chamber, which enters said chamber through two mouths provided with as many anti-return valves which open in opposite directions. One of these mouths is located in a centred position and inside it a conduit is fixed in the cover, which co-axially runs through the chamber and reaches the piston.

A tube runs co-axially through the tubular shank of the piston, reaching a front housing located in the anterior base of said piston. The wall of this tube has orifices in its wall near the aforementioned mouth, and in addition the tube may be partially displaced with respect to the piston by the action of the following section of the telescopic jib in its retraction position. This tube has a greater diameter than the conduit which is integrally joined to the central mouth of the expansion chamber cover, such that when the piston is displaced in the retraction direction, said tube co-axially receives the conduit joined to the cover. The tubular shank and the tube running inside the latter define, in the external head of the shank, two coaxial chambers provided with a mouth for intercommunication to the expansion and retraction chambers of the cylinder housed in the following section of the telescopic arm.

With the above described composition, when the piston reaches its maximum expansion run the aforementioned tube and conduit remain extended, while during the retraction stage, the conduit integrally joined to the cover is gradually introduced in the tube which runs through the tubular shank. The conduit integrally joined to the cover has passage orifices in its wall, near the end which reaches the housing of the anterior base of the piston. Between these orifices and the free end, this conduit is provided with a bushing which may move between an anterior position in which it closes the aforementioned passage orifices and a rear position where it rests on the bottom of the front housing of the piston and closes the passage through the tube running inside the tubular shank. The bushing can be moved towards the anterior position by the action of the following section of the telescopic jib through the mentioned tube, and towards the rear position by means of a recovery spring.

The external head of the shank has a pilot piston or an axially displaceable piston which may be activated by the following section of the telescopic jib in its retraction position. This pilot or displaceable piston causes a partial displacement of the tube running inside the tubular shank, provoking the displacement of the bushing fitted over the cover conduit towards its anterior position.

All of the expressed features, as well as others pertaining to the invention and the cylinder operation, may be understood better with the following description made with reference to the accompanying drawings, in which a non-limiting example of an embodiment is shown.

Figure 1:
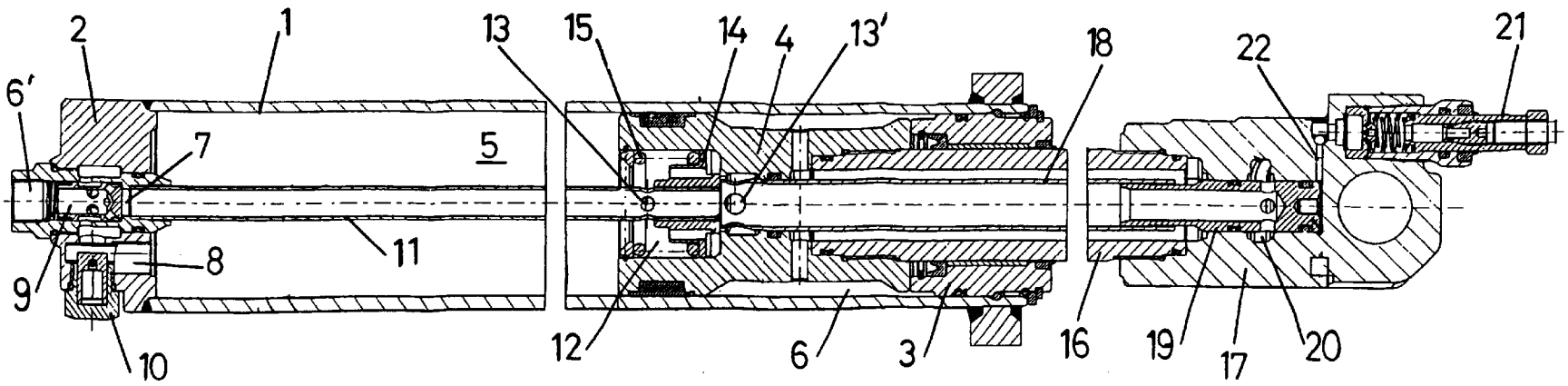
FIG. 1 is a longitudinal section of a hydraulic cylinder formed according to the invention, in a retracted position.
Figure 2:
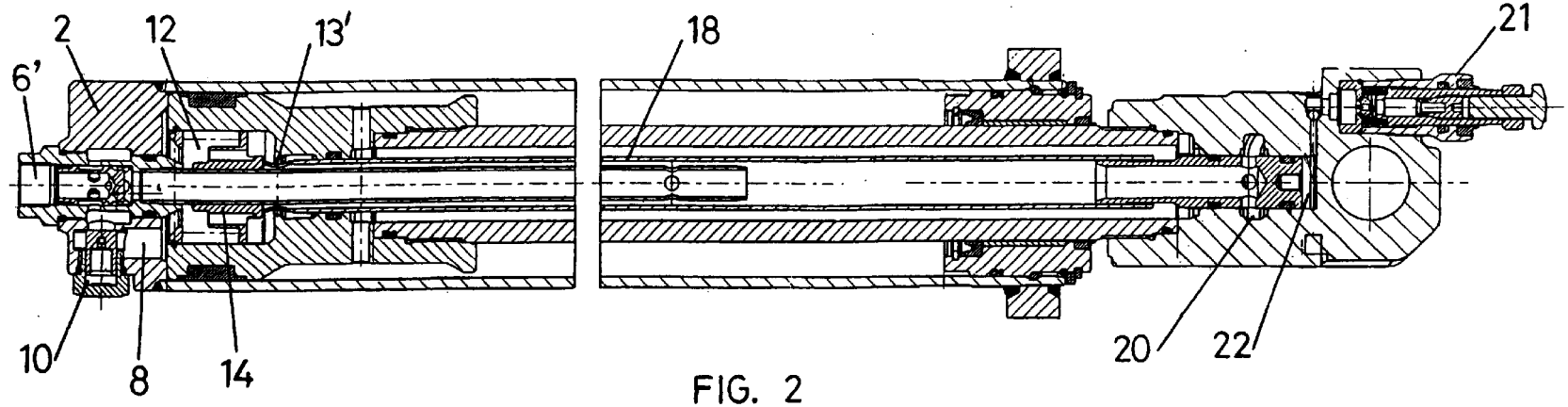
FIG. 2 is a view similar to FIG. 1, with the cylinder in the extended position.

The cylinder shown in FIGS. 1 and 2 comprises a cylindrical sleeve 1 which is closed by means of end covers 2 and 3. Inside this sleeve is housed a piston 4 which may be displaced along said sleeve and which delimits an anterior expansion chamber 5 and a rear retraction chamber 6.

The cover 2 has a passage hole 6' into the chamber 5 which enters it through two mouths labelled by numbers 7 and 8, each one of which being provided with the corresponding anti-return valves 9 and 10. In the mouth 7, arranged in a central position, a conduit 11 is fixed which co-axially runs inside chamber 5.

The piston 4 is provided on its anterior base with a housing 12 which is reached by the conduit 11, which in turn has passage orifices 13 in its wall, near the free end. This conduit 11 has a sliding bushing 14 between its free end and the orifices 13, which can rest on the bottom of housing 12, towards which it is pushed by the spring 15.

The piston 4 includes a tubular shank 16 which protrudes through the cover 3 by a portion on which is fitted an external head 17. Inside the tubular shank 16, a tube 18 runs which penetrates the head 17 through a tubular extension 19 having in its wall some orifices 13' which reach an annular chamber 20. The tube 18 and its extension 19 can partially slide with respect to the tubular shank 16 and head 17. In the example represented in FIGS. 1 and 2, the displacement of this tube 18 and extension 19 is caused by a pilot piston 21 through which grease or oil under pressure may be injected, reaching chamber 22 to displace the extension 19 and tube 18, provoking their partial displacement in the housing 12 of the piston 4 and hence pushing on the sliding bushing 14.

As may be observed in the drawings, conduit 11 integrally joined to the cover 2 has a smaller diameter than the tube 18 housed in the shank 16.

Chamber 6 is provided in sleeve 1 with a passage hole 23. See FIG. 4.

The head 17 has two intercommunication mouths labelled by the numbers 24 and 25 (FIGS. 4 and 5), the first of which leaves from the annular chamber limited between the tubular shank 16 and the internal tube 18, whilst the second leaves from the annular chamber 20.

Figure 3:
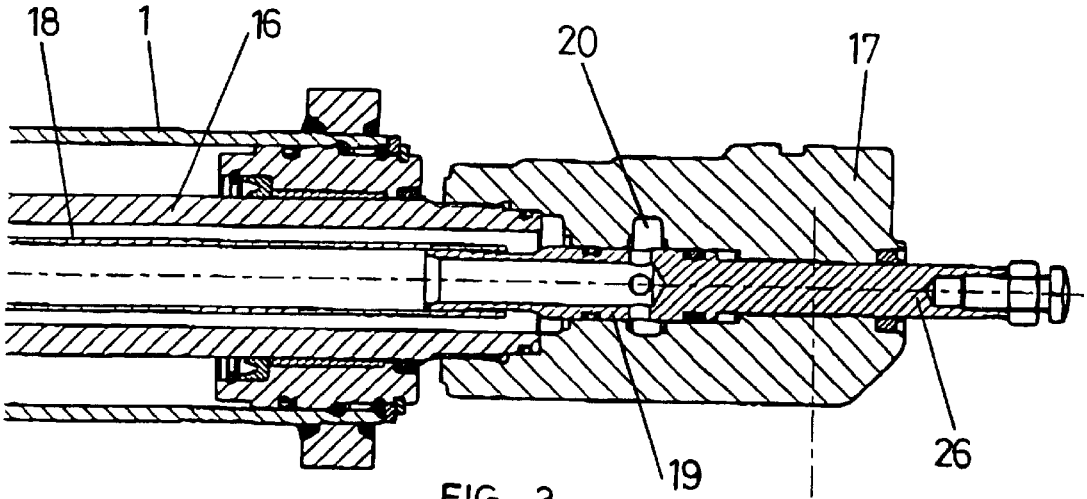
FIG. 3 is a diametric section of the external head of the shank, showing another embodiment.
Figure 4:
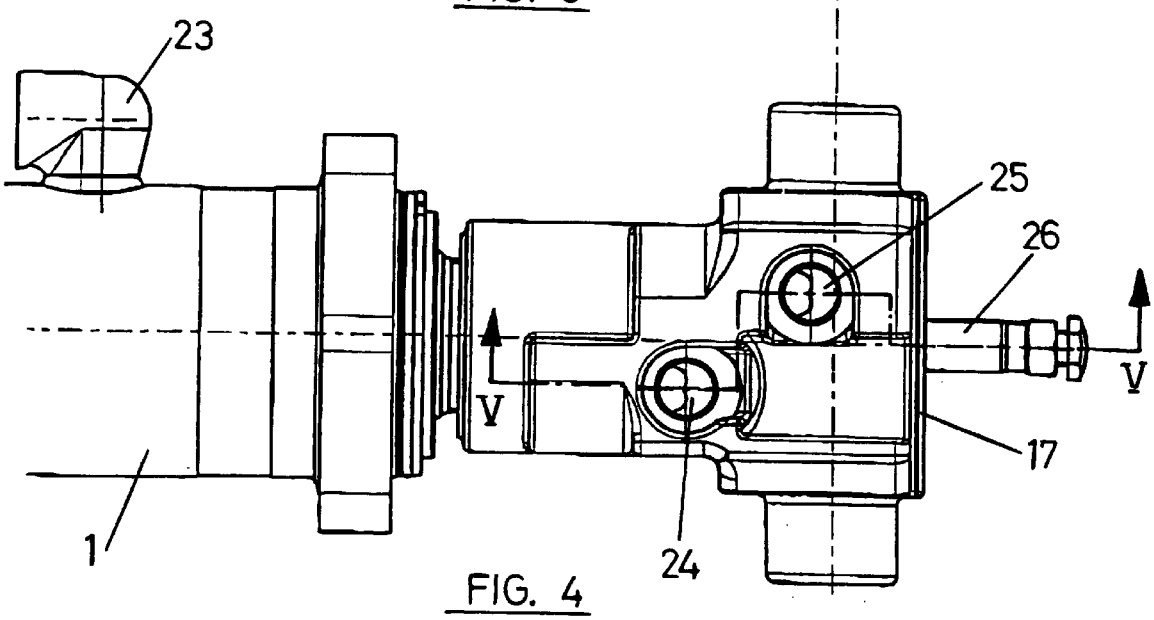
FIG. 4 is an upper plan view of the extreme head of the shank of FIG. 3.
Figure 5:
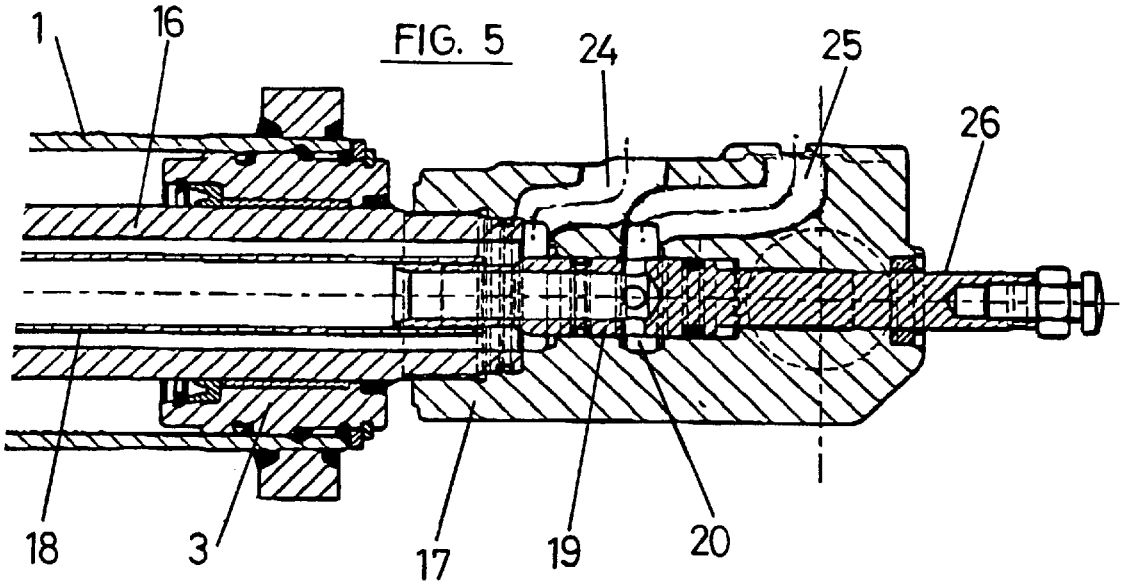
FIG. 5 is a section of the external head of the shank taken along the cutting line V—V of FIG. 4.

The displacement of the tubular extension 19 and tube 18 may also be achieved, as indicated in FIGS. 3 to 5, by means of a displaceable piston 26 which axially protrudes with respect to head 17 and which internally rests on the tubular extension 19, or is integrally joined to the said extension forming a single part with it.

In the case of the pilot piston 21, action on the tubular extension 19 is possible by hydrostatic transmission and by a return spring, as may be seen in FIGS. 1 and 2.

The operation of the piston described is expressed below, together with FIG. 6, in which a possible application is shown consisting of a telescopic arm crane 30 comprising, in the described case, five telescopically inserting sections which are labelled with the numbers 31 to 35, each of which including a cylinder such as that described with reference to FIGS. 1 to 5.

Figure 6:
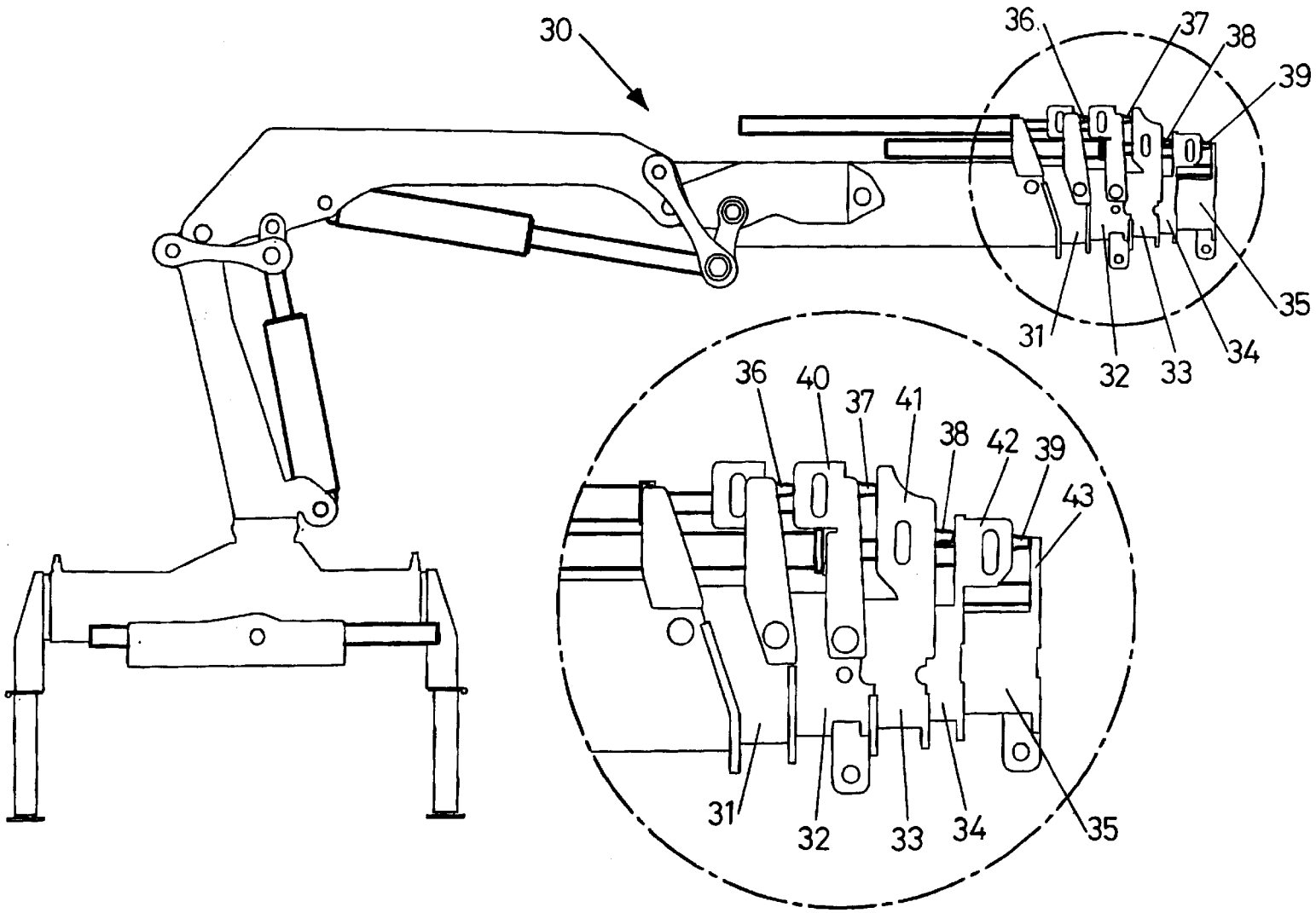
FIG. 6 is a side view of a possible application in a telescopic arm crane of five sections.

In FIG. 6, labels 36 to 39 refer to the pilot piston 21 or sliding piston 26 which is mounted on the head end of the shank and which in the retracted position of the assembly is actuated by a stop 40, 41, 42 and 43 of the following section.

Starting from the retracted position of the telescopic sections shown in FIG. 6, the piston 36 to 39 of the different sections is actuated by the stop 40 to 43 of the following section.

The cylinder is in the position of maximum retraction shown in FIG. 2 with the pilot piston 21 activated, such that the grease introduced under pressure reaches the chamber 22 and maintains displaced the tubular section 19 and internal tube 18, partially protruding into the housing 12 of the piston and hence maintaining the sliding bushing 14 separated from the seating or housing bottom.

In this situation, by means of the activation of a known hydraulic distributor, oil is injected to the expansion chamber 5 through the mouth 6', opening the anti-return valve 10 and entering through orifice 8. Whilst the sliding bushing 14 is separated from the housing bottom 12, the hydraulic fluid injected through the mouth 6, passes through the orifices 13 and tube 18, reaching the annular chamber 20 and leaving through the orifice 25 which momentarily feeds the following hydraulic cylinder. However, as soon as the displacement of the telescopic section carrying this following cylinder is large enough so that it no longer acts on the pilot piston 21 or sliding piston 26, the sliding bushing 14 reaches the bottom of housing 14, closing the passage of hydraulic fluid. In this way, the hydraulic fluid introduced through the mouth 6 acts on the piston 4 by displacing it towards the expansion position, until the sliding bushing 14 surpasses the orifices 13 of the conduit 11, which moment coincides with the end of the run of the piston 4. At this moment the hydraulic fluid passes through the orifices 13, conduit 11, tube 19 and annular chamber 20 to feed the following cylinder through its corresponding mouth 6'. In this way, the successive feeding of the cylinders corresponding to the different sections is achieved, until the total extension of the telescopic arm is achieved.

The retraction manoeuvre takes place inversely, starting from the piston position shown in FIG. 1, with the pilot piston 21 or displaceable piston 26 not pressed on by the following cylinder, which is starting to retract. In this situation the hydraulic distributor sends fluid to chamber 6 through the orifices 23 of all and each one of the telescopic arm cylinders, which are always connected.

Under these conditions, all the cylinders receive pressure in the retraction chamber 6 of the piston and all of them may retract until the displacement of the piston towards the left makes the sliding bushing 14 close the passage of the orifices 13, such that the fluid from chamber 5 cannot leave towards the mouth 6' as valve 10 closes the passage.

When the following cylinder arrives near the end of its retraction run, the arm on which it acts presses on the pilot piston 21 or displaceable piston 26 of the cylinder described, causing a leftwards displacement of the internal tube 9. This displacement produces the opening, by pushing, of the closure between the sliding bushing 14 and the housing bottom 12, such that the fluid trapped in chamber 5 of the piston passes through this area and through the orifices 13' of end of the tube 18 towards the interior of conduit 11, opening the anti-return valve 7 such that the fluid leaves through mouth 6 until this cylinder is fully retracted. The latter cylinder will in turn push the piston 21 or 26 of the preceding cylinder, hence producing the same sequence of events.

In this way, a cylinder is obtained for telescopic arms, where the consecutive arms act over a pilot piston 21 or sliding piston 26, which is not part of the hydraulic circuit of the cylinder.

What is claimed is:

1. A hydraulic cylinder system for a telescopic arm consisting of several telescopic sections, which are sequentially extended and retracted; each section housing a cylinder which is activated when the cylinder of the section immediately after or before it, respectively, finishes its movement, in the extension and retraction stages, respectively;

wherein each cylinder includes a sleeve closed by a rear cover and an extension cover, a piston dividing the sleeve into expansion and retraction chambers, a tubular shank associated with the piston and protruding through the rear cover;

wherein the expansion cover includes an expansion port, which is connected to the expansion chamber through the first and second expansion passages, with each of the first and second expansion passages having a respective first and second check valve, wherein the first and second check valves allow flow in opposite directions;

wherein a conduit is fixed to the first expansion passage which is centered on the expansion cover, with the conduit coaxial with the sleeve and having orifices near its free end; a bushing displaceably mounted to the conduit between the orifices and the free end, biased by a recovery spring toward a rear position, and moveable to an anterior position, closing the orifices of the conduit;

a tube coaxial with and interior to the tubular shank, with the tube and the tubular shank both fixed to an external head, thereby defining first and second transfer passages therebetween, which communicate with the retraction and expansion chambers, respectively, of the cylinder housed in the following section of the telescopic arms; wherein the tube has orifices near an end adjacent an anterior base of the piston, is displaceable relative to the piston and has a diameter greater than a diameter of the conduit, such that during retraction of the piston, the conduit is introduced into the tube; wherein the second transfer passage is closed by the bushing when it is in its rear position, and includes an interior of the tube; and wherein the bushing is moved towards its anterior position, by action of the following section of the telescopic arms, via the tube.

2. A hydraulic cylinder system according to claim 1, wherein the external head has a pilot piston, activated by the following section of the telescopic arm, in its retracted position; wherein activation of the pilot piston causing the displacement of the tube, which displaces the bushing toward its anterior position.

3. A hydraulic cylinder system according to claim 1 wherein the external head has an axially displaceable piston, activated by the following section of the telescopic arm, in its retracted position; wherein activation of the axially displaceable piston causing displacement of the tube, which displaces the bushing toward its anterior position.

* * * * *